United States Patent [19]

Kearney

[11] Patent Number: 4,862,621

[45] Date of Patent: Sep. 5, 1989

[54] DEVICE FOR FACILITATING LOADING OF A SHOTGUN

[75] Inventor: John M. Kearney, Rochester, N.Y.

[73] Assignee: Armstec, Inc., Rochester, N.Y.

[21] Appl. No.: 118,535

[22] Filed: Nov. 9, 1987

[51] Int. Cl.[4] ..... F42B 39/06

[52] U.S. Cl. ..... 42/87

[58] Field of Search ..... 42/87, 90

[56] References Cited

U.S. PATENT DOCUMENTS

| | | | |
|---|---|---|---|
| 211,691 | 1/1879 | Bennett | 42/87 |
| 3,808,723 | 5/1974 | Erixon | 42/87 |
| 4,509,284 | 4/1985 | Naber | 42/87 |
| 4,756,110 | 7/1988 | Beltron | 42/87 |

*Primary Examiner*—Charles T. Jordan

*Attorney, Agent, or Firm*—Lawrence P. Kessler

[57] ABSTRACT

A device which facilitates the speed loading of shells into a shotgun and which is accurately alignable with the magazine of the shotgun for readily repeatable operation. Such device comprises a mechanism for providing a location position relative to the magazine, and an elongated tube, adapted to contain a plurality of shells in end to end relation. The tube includes an opening defined in one end thereof through which such shells are inserted into and removed from said tube. At least one projection is provided in the tube for releaseably retaining such shells within said tube. Additionally, an external means is provided for engaging the location mechanism so as to accurately register the open end of the tube at the location position, and a plunger located within the tube rapidly expells such shells from the tube past the projection into the magazine when the tube is registered in its location position relative to the magazine.

8 Claims, 2 Drawing Sheets

DEVICE FOR FACILITATING LOADING OF A SHOTGUN

BACKGROUND OF THE INVENTION

This invention relates in general to apparatus for loading cartridges into weapons, and more particularly to a device for facilitating the speed loading of shells into a shotgun.

In certain classes of firearms, mechanical devices have been designed to facilitate rapid loading of multiple cartridges. While such devices have been generally successful for revolvers and rifles, little attention has been directed to enabling the speed loading of shotguns. Speed loading of shotguns is highly desireable, particularly in competitions where overall time for both loading of the weapon and firing a specified number of rounds is a significant factor. Additionally, speed loading of shotguns for law enforcement personnel, who have been adopting shotguns as the major weapon of choice, is of critical importance for both effective execution of their duties and their own personal saftey.

Today one of the only mechanical devices for facilitating the speed loading of shotguns is a flexible, shell retaining tube shown and described in U.S. Pat. No. 4,509,284 (issued Apr. 9, 1985 in the name of Naber). The tube of this patent is aligned with the shotgun magazine and a plunger is moved to expand the tube and force the shells into the magazine. However, this device is hard to manipulate to align the tube with the magazine during its loading function, which often results in its malfunctioning.

SUMMARY OF THE INVENTION

This invention is directed to a device which facilitates the speed loading of shells into a shotgun and which is accurately alignable with the magazine of the shotgun for readily repeatable operation. Such device comprises a mechanism for providing a location position relative to the magazine; and an elongated tube, adapted to contain a plurality of shells in end to end relation. The tube includes an opening defined in one end thereof through which such shells are inserted into and removed from said tube. At least one projection is provided in the tube for releaseably retaining such shells within said tube. Additionally, an external means is provided for engaging the location mechanism so as to accurately register the open end of the tube at the location position, and a plunger located within the tube rapidly expells such shells from the tube past the projection into the magazine when the tube is registered in its location position relative to the magazine.

The invention, and its objects and advantages, will become more apparent in the detailed description of the preferred embodiment presented below.

BRIEF DESCRIPTION OF THET DRAWINGS

In the detailed description of the preferred embodiments of the invention presented below, reference is made to the accompanying drawings, in which.

DESCRIPTION OF THE PREFERRED EMBODIMENTS

Figure 1:
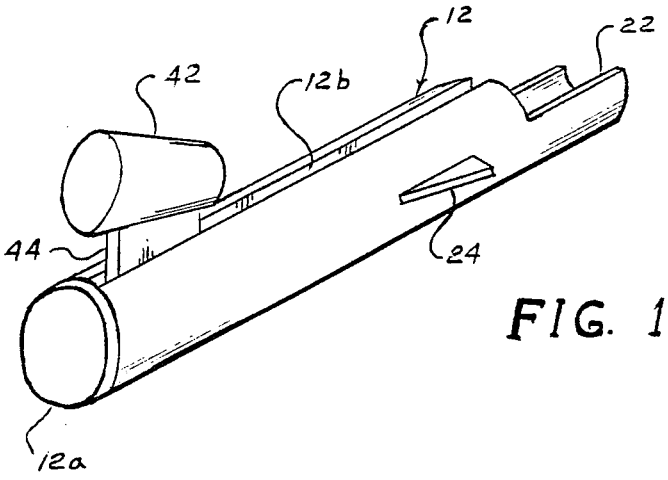
FIG. 1 is a view, in perspective, of the device in accordance with this invention for facilitating the speed loading of shells into a shotgun.
Figure 3:
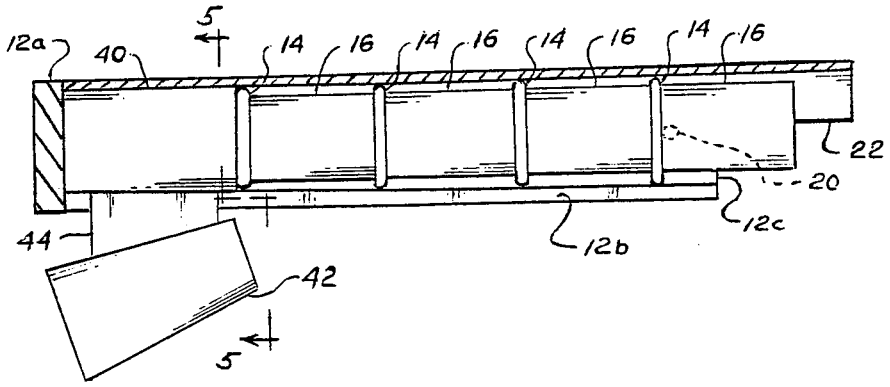
FIGS. 3 is a side elevational view, in cross-section, of the shotgun speed loading device of FIG. 1.
Figure 4:
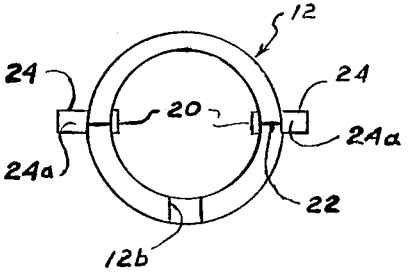
FIG. 4 is an end elevational view of the shotgun speed loading device of FIG. 1.
Figure 5:
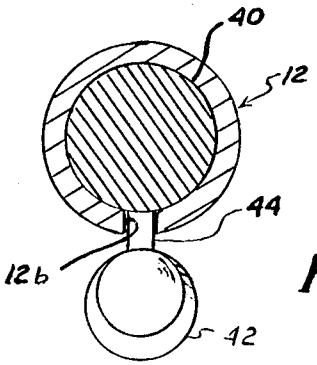
FIG. 5 is an end elevational view, in cross-section, of the shotgun speed loading device taken along the lines 5—5 of FIG. 3.

Referring now to the accompanying drawings, a mechanical device according to this invention for facilitating the speed loading of shells into a shot gun is designated generally by the numeral 10. The speed loading device 10 includes a relatively rigid elongated tube 12, formed for example of a thermoplastic or sheet metal material. As best shown in FIG. 3, the tube 12 is sealed by a closure member at one end 12*a*, and has a slot 12*b* extending along a longitudinal element of of the tube from the end 12*a* to the opposite end 12*c*. The inside diameter of the tube 12 is slightly larger than the diameter of the flange 14 of a typical shotgun shell 16, and its length is such that it will accomodate a number of shells (e.g., four) which will fill the standard magazine of a shotgun. The end 12*c* of the tube 12 is open to enable inserting and removing shells 16 from the tube. A plurality of projections 20 (see FIGS. 3 and 4) are formed in the tube 12 at a distance from the end of the tube approximately equal to the length of a typical shotgun shell. The projections 20 extend into the travel path of the shell flange 14 so as to normally retain shells 16 within the tube 12. However, when the shells are inserted into or removed from the tube 12, the force of the shell flanges 14 against the projections increases the diameter of the tube to enable the shells to move past the projections. Such increase in the tube diameter is possible because of the split in the tube 12 formed by the slot 12*b*.

Figure 2:
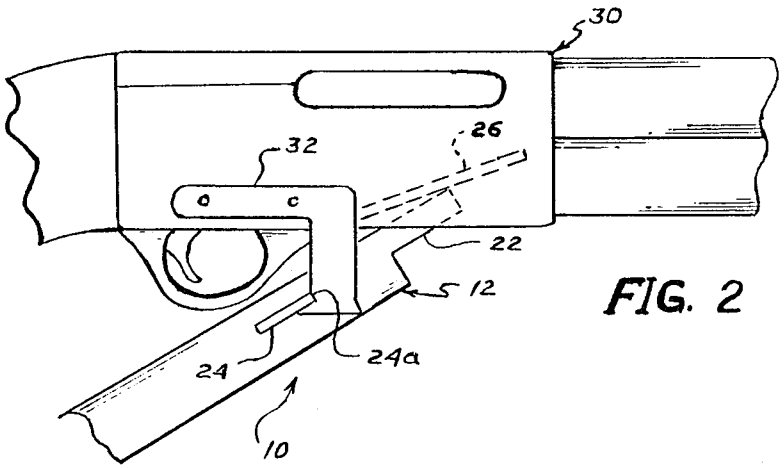
FIG. 2 is a side elevational view, of a shotgun with the speed loading device of FIG. 1 associated therewith, with portions broken away to facilitate viewing.

The tube 12 of the device 10 further includes an extension portion 22 and alignment members 24. The extension portion 22 extends forwardly from the end 12*c* of the tube 12 and is coextensive with a segment of the circumference of the tube opposite the slot 12*b*. The purpose of the portion 22 is to provide a guide for the shells 16 being fed into and removed from the tube, and to depress a shell carrier or open a magazine door of a shotgun if the shotgun is so equiped (see for example, door 26 of shotgun 30 in FIG. 2). The alignment members 24 project externally from the tube 12, in a substantially radial direction, adjacent to the end 12*c* upstream of the portion 22. The members 24 respectively include an engagement surface 24*a* which mates with a locating mechanism 32 attached to the shotgun 30. The locating mechanism 32 may be, for example, a pair of bracket members respectively mounted on either side of the receiver of the shotgun adjacent to but not interferring with the trigger mechanism or the functioning of the shotgun. Although other locating mechanisms would be suitable for use with this invention depending upon the construction of the shotgun and its magazine, it is an important aspect that the position of the locating mechanism be such that when the surfaces 24*a* of the alignment members 24 engage the locating mechanism, the tube 12 of the speed loading device 10 is accurately registered with the shotgun mechanism.

In order to effect speed loading, the device 10 includes a plunger 40 located within the tube 12. Although other configurations are suitable for use with this invention, the plunger 40 of this preferred embodiment is substantially cylindrical and has a cross-sectional area which enables it to slide freely within the tube. A handle 42 is connected to the plunger 40 by a connecting web 44 which passes freely through the slot 12*b* in the tube 12. The handle is conveniently shaped to be readily grasped by the human hand for selectively moving the plunger in a desired direction.

In the operation of the speed loading device 10 of this invention, with the plunger 40 located adjacent to the closed end 12*a* of the tube 12, a plurality of shells 16 are manually inserted in the tube through end 12*c*. The extension portion 22 aids in guiding placement of the shells into the tube, while the projections 20 retain the inserted shells therewithin. The device 10 is thus in a ready condition, and can be conveniently carried, such as for example on one's person, until it is desired to employ the device in speed loading the shotgun. When such loading is desired, the device is accurately registered relative to the magazine of the shotgun 30 by engaging the surfaces 24*a* of the aligning portions 24 with the locating mechanism 32 in the manner described above. The extension portion 22, upon registration, orients the tube 12 with respect to the the magazine so that the shells 16 within the tube will be aligned with the magazine. If the magazine has a shell carrier or door, such as door 26 shown in FIG. 2, the extension portion will open the door or depress the carrier to provide access to the interior of the magazine. Thereafter, the handle 42 is manually actuated to rapidly move the plunger 40 in the tube 12 away from the end 12*a* toward the end 12*c*. This action of the plunger will force the shells 16 out of the tube and into the magazine. The shotgun 30 is thus rapidly loaded in a reliable and repeatable manner.

The invention has been described in detail with particular reference to a preferred embodiment thereof, but it will be understood that variations and modifications can be effected within the spirit and scope of the invention.

I claim:

1. For use with a shotgun having a magazine adapted to contain a plurality of shells, a device for facilitating the speed loading of shells into such magazine, said device comprising:

means for providing a location position relative to said magazine, said means defining a receiving surface of a preselected configuration externally attachable to said shotgun adjacent to said magazine; and a relatively rigid elongated tube, adapted to contain a plurality of shells in end to end relation, said tube including an opening defined in one end thereof through which such shells are inserted into and removed from said tube, at least one projection extending from the interior wall of said tube toward the center thereof into the path of such shells when inserted into or removed from said tube, and external member complementary to said preselected configuration of said receiving surface of said location providing means, said member adapted to precisely mate with said receiving surface for engaging said location means so as to accurately register the open end of said tube at said location position, and means located within said tube for rapidly expelling such shells from said tube past said at least one projection into said magazine when said tube is registered in said location position relative to said magazine, said at least one projection normally remaining in said path and being movable out of said path by the force of a shell being inserted into or removed from said tube.

2. The invention of claim 1 wherein said location means includes a bracket fixed to said shotgun adjacent to said magazine.

3. The invention of claim 1 wherein said expelling means includes a plunger located within said tube and a handle connected to said plunger extending to a location external of said tube, said handle being movable relative to said tube to accuate said plunger.

4. The invention of claim 3 wherein said tube defines a longitudinal slot extending for substantially the length thereof along an element of its surface, and wherein said plunger is connected to said handle by a member extending through and guided by said slot.

5. For use with a shotgun including a magazine adapted to contain a plurality of shells of the type having a radially extending flange, said magazine having movable means for selectively providing access to said magazine, a device for facilitating speed loading a plurality of shells into said magazine, said device comprising:

means for providing a location position relative to said magazine, said means defining a receiving surface of a preselected configuration externally attachable to said shotgun adjacent to said magazine; and a relatively rigid elongated tube adapted to contain a plurality of shells in end to end relation, said tube including an opening defined in one end thereof through which such shells are inserted into and removed from said tube, at least one projection extending from the interior wall of said tube for normally retaining shells within said tube and movable out of such path by the force of a shell being inserted into or removed from said tube, an external member complementary to said preselected configuration of said receiving surface of said location providing means, said member adapted to precisely mate with said receiving surface for engaging said location means so as to accurately register said opening of said tube at said location position, means extending from said tube adjacent to said opening thereof for moving said magazine access means to a position where access to said magazine is provided when said tube is registered in said location position, and means located within said tube for rapidly expelling such shells from said tube past said retaining means into said magazine when said tube is registered in said location relative to said magazine.

6. The invention of claim 5 wherein said location means includes a bracket fixed to said shotgun adjacent to said magazine.

7. The invention of claim 5 wherein said expelling means includes a plunger located within said tube and a handle connected to said plunger extending to a location external of said tube, said handle being movable relative to said tube to accuate said plunger.

8. The invention of claim 7 wherein said tube defines a longitudinal slot extending for substantially the length thereof along an element of its surface, and wherein said plunger is connected to said handle by a member extending through and guided by said slot.

* * * * *